US005388185A

United States Patent [19]

Terry et al.

[11] Patent Number: 5,388,185

[45] Date of Patent: Feb. 7, 1995

[54] SYSTEM FOR ADAPTIVE PROCESSING OF TELEPHONE VOICE SIGNALS

[75] Inventors: Alvin M. Terry, Longmont, Colo.; Thomas P. Krauss, Ithaca, N.Y.

[73] Assignee: U S West Advanced Technologies, Inc., Boulder, Colo.

[21] Appl. No.: 767,476

[22] Filed: Sep. 30, 1991

[51] Int. Cl.[6] ..... G10L 3/02

[52] U.S. Cl. ..... 395/2.14; 395/2.1; 395/2.8; 381/29

[58] Field of Search ..... 381/68.2, 29; 395/2.14, 395/2.1, 2.8; 379/390, 52

[56] References Cited

U.S. PATENT DOCUMENTS

| | | | |
|---|---|---|---|
| 4,051,331 | 9/1977 | Strong et al. | 381/68.2 |
| 4,181,813 | 1/1980 | Marley | 395/2.6 |
| 4,596,900 | 6/1986 | Jackson | 379/105 |
| 4,637,402 | 1/1987 | Adelman | 128/746 |
| 4,764,957 | 8/1988 | Angeline et al. | 379/433 |
| 5,029,217 | 7/1991 | Chabries et al. | 381/68.2 |
| 5,083,312 | 1/1992 | Newton et al. | 381/68.2 |
| 5,170,430 | 12/1992 | Schuh | 379/390 |

OTHER PUBLICATIONS

Holmes, Alice E., and Tom Frank. (1984) Telephone Listening Ability for hear-impaired individuals. Ear and Hearing, 5, 96–100.

Lippmann, R. P., Braida, L. D., and Durlach, N. I., (1981) "Study of Multichannel Amplitude Compression and Linear Amplification for Persons with Sensorineural Hearing Loss," J. Acoust. Soc. Am. 69(2), 524–533.

Lybarger, Samuel F. (1982) Telephone coupling. In "The Vanderbilt Hearing Aid Report: State of the Art Research Needs," G. A. Studebaker and F. H. Bess(eds), 91–93.

Villchur, E. (1973). "Signal Processing to Improve Speech Intelligibility in Perceptive Deafness," J. Acoust. Soc. A. 53, 1646–1657.

Holmes, Alice E., Acoustic vs. Magnetic Coupling for Telephone Listening of Hearing-Impaired Subjects, The Volta Review, May, 1985, pp. 215–223.

Holmes, Alice E., Chase, Nancy A.; Listening Ability with a Telephone Adapter, Hearing Instruments, vol. 36, No. 9 (1985), pp. 16–57.

*Primary Examiner*—David D. Knepper
*Assistant Examiner*—Jariq Hafiz
*Attorney, Agent, or Firm*—Timothy R. Schulte

[57] ABSTRACT

A system for adaptively processing a telephonic speech signal performs modification in either the spectral domain or the time domain to bring the power in each frequency above the hearing threshold of the listener but below the upper limit of the listener's dynamic range.

19 Claims, 5 Drawing Sheets

SYSTEM FOR ADAPTIVE PROCESSING OF TELEPHONE VOICE SIGNALS

TECHNICAL FIELD

This invention relates to a system for adaptive processing of speech signals for hearing impaired listeners, and has particular utility in adaptively processing telephonic speech signals to compensate the signal for hearing impaired listeners.

BACKGROUND OF THE INVENTION

As much as twenty percent of the population has some sort of hearing difficulty. It is typical for persons over 50 years of age to experience progressive loss in their aural perception in the high frequency part of the audio spectrum. A large percentage of those who have hearing impairment are aided in their understanding of speech in face-to-face communications by their familiarity with visual cues, and because the other persons speaking to them will adjust the loudness of their voices.

However, visual cues are not available to the hearing impaired listener in a telephone conversation, and non-verbal interaction between communicants on the telephone is not possible. Also, there is from time-to-time the added problem of telephone noise and speech signal distortion which will add to the problems of the hearing impaired.

Moreover, many of those with hearing impairments do not have hearing aids. Even those hearing impaired persons who have hearing aids may have problems when attempting to use the hearing aid with a telephone due to feedback occurring because of the close proximity of the telephone receiver and hearing aid microphone, and difficulty in maintaining the optimum position of the telephone receiver. It is not uncommon for someone to have a hearing aid fitted to their best ear, but because of the problem of hearing aid—receiver interaction, the person uses the other ear for telephone communications.

It is known that the speech spectrum exists mainly in the band below 8,000 Hz, and that the most important region lies below 5000 Hz. Most of the power of the signal is contained in the band 100 to 1000 Hz, while the middle to higher frequencies contribute significantly to the intelligibility of the signal. The speech signal has a great deal of redundancy, in fact the band below 1500 Hz has about the same amount of intelligibility as the band above 1500 Hz. The telephone signal capitalizes on this redundancy and uses a band of 300 to 3200 Hz for voice signals.

While for the average person the telephone signal typically gives an intelligibility of better than 90%, for a significant minority of the population who have hearing impairments the telephone signal can present varying degrees of intelligibility.

At each frequency level within the telephonic bandwidth, the hearing characteristics of a particular listener may be measured by two parameters. First, is the threshold value ("T") which indicates the power level that each frequency point must have for the listener to be able to hear that particular frequency. Second, is the limit ("S") on the listener's dynamic range at each frequency point, which indicates when the listener will experience pain or discomfort when the power level at the frequency point is increased.

The T and S values constitute a hearing profile which characterizes an individual listener. These profiles may commonly grouped or classified to match typical hearing impairment problems. Alternatively, the hearing profile of any particular listener may be unique to the aural impairment, disorder or disease suffered by that listener. Both the typical classifications of hearing impairment profiles and the unique hearing impairment profiles may be recorded and stored in a database for retrieval for adaptive processing of speech signals in the manner provided by the present invention.

DISCLOSURE OF THE INVENTION

The present invention is a system for adaptively processing speech signals to compensate for hearing impairment. The system makes use of a model of the hearing profile of an impaired user. The system then effects noise removal from the speech signal, compensates the signal for increased sensory thresholds and abnormal loudness perception, and may also enhance the formant and transitional cues present in the speech signal to improve its perception and intelligibility to hearing impaired users of the system.

The system is preferably implemented in a telephone network. The system may be accessed prior to, or during, a telephone-conversation by either the person placing or receiving the call. The system database is provided with the hearing profile of the impaired user, i.e. hearing threshold curves and equi-loudness contours, so that appropriate frequency gain and compression can be provided to match the requirements of the hearing impaired user. Alternatively, the database may have already been furnished with hearing profiles for typical impairments, so that a user can select one of the typical profiles via a touch-tone telephone to meet the requirements of the hearing impaired listener, i.e. a "prescription call-in" feature.

The preferred algorithmic steps for adaptive speech processing are generally described as follows. First, the analog speech signal is converted into digital form, or if already in a digital form it is converted into a linear 16-bit integer representation. The digital signal is then filtered to remove noise. The filtered digital signal then undergoes a Fourier transformation into the frequency domain, and each frequency component of the speech signal is represented by a point value (represented by real and imaginary coordinate values in the complex spectrum). A spectral modification is then performed by multiplying each point value based on the particular adjustment needed at that frequency level according to the requirements of the particular hearing impaired listener. The multiplication of the frequency point value is intended to modulate the power in that frequency to be within the range defined by the sensory threshold ("T") at the low end and the dynamic limit ("S") at the high end. The modulated frequency point values are then inversely transformed from the frequency domain to a digital representation of the speech signal. The re-digitalized signal is then further reconstructed by using an overlap and add method to prevent aliasing effects and to optimize its intelligibility to the hearing impaired listener. Finally, the digitized signal is re-converted to analog form for transmittal to the telephone receiver and improved perception by the hearing impaired listener.

In an alternative embodiment, the algorithmic steps may be implemented in a time domain processing method. In this method, signal compression at selected frequencies is implemented by adjusting the gain of frequency specific filters. Each filter has a different center frequency, and the center frequencies are octave-spaced within the telephone bandwidth.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

The principal application of the present invention is within a telephone network as a system for adaptively processing speech signals for hearing impaired telephone users. Therefore, the following description of the system is within the environment of a telephone network.

Figure 1:
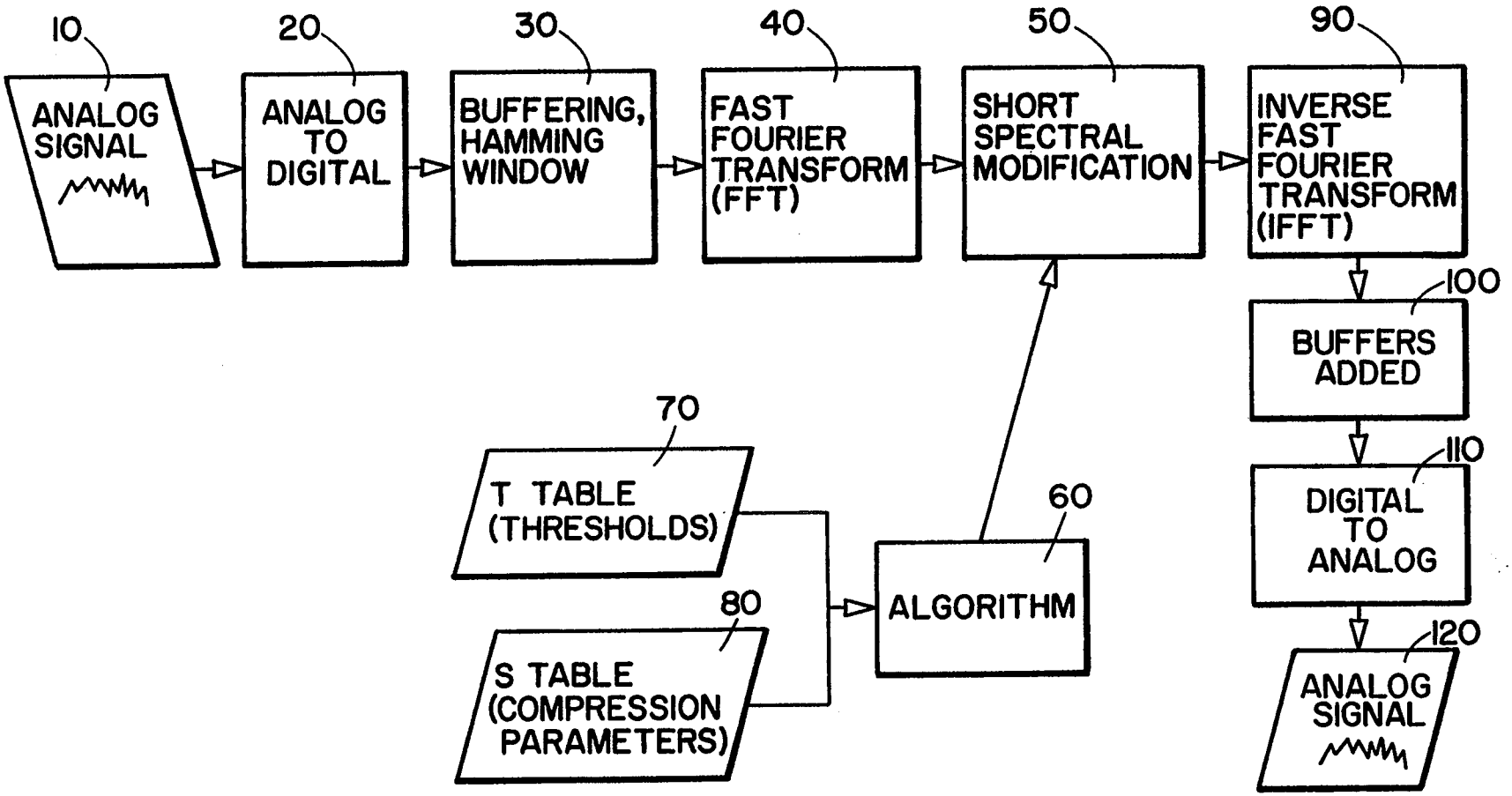
FIG. 1 is a block diagram illustrating the process steps involved in the adaptive processing system of the present invention.

With reference to FIG. 1, an analog signal 10 is representative of a speech signal generated at the sending end by a telephone user. However, the signal may also be generated by a microphone, tape recording, oscillator, or other source of audio analog signal.

The analog signal is converted to digital form in step 20. The resulting digital signal should have a 16-bit format for necessary precision. The analog-to-digital signal conversion may be performed in a conventional manner, and it has been found that the commercially available Ariel Digital Signal Processing Board (which uses a DSP-32C-chip) is suitable for this application.

In step 30, the digitized speech signals are buffered and placed through a Hamming Window preparatory to transformation into the frequency domain. The purpose of step 30 is to modify the speech signal to simulate a continuous, periodic signal function which can be operated on by a Fourier transformer. For this purpose, each digitized speech signal sample is placed into one of four buffers in the time domain. At every 64th sample, the 256 most recent samples are copied into an overlap buffer. There are four buffers, each with 256 samples in them, and only 64 samples of which overlap between all four buffers.

Each of the four overlap buffers is modified by a Hamming Window which shapes the buffer in such a way that the samples at the extreme ends are given much less weight than those samples toward the center of the buffer. Multiplication by this Hamming Window reduces edge effects that are the normal result of analyzing a finite segment of a signal; the trade-off is a smoothed spectrum with lower resolution. Adding the four overlap buffers after windowing will produce a reconstruction of the signal that was originally input to the system.

In step 40, each buffer is processed using a Fast Fourier Transform. After passing through the transform, the signal contained in the buffer has unique values for 128 points (half of the 256 points, since the signal in the frequency domain is evenly symmetric). The point values are equally spaced over an 8 kHz band, because sampling is done at 16 kHz. Alternatively, the sampling rate can be set at 8 kHz so that a band of 0 to 4000 Hz is processed, which is closer to the current telephone speech band of 300 to 3200 Hz.

In step 50, spectral modification is performed by an algorithm 60. Each spectral point value is multiplied by a factor which is based on the particular hearing loss algorithm suited for the particular hearing impaired user. The algorithm 60 considers two factors called the threshold value ("T") and the slope value ("S"). The threshold values for each point are contained in a table, called the T table 70, which indicates the power level that each frequency point must have for the hearing impaired subject to be able to hear that particular frequency. This allows each point to be amplified to the threshold value for that particular user.

The slope values for each point are contained in a table, called the S table 80, which indicates the amount of compression that is necessary at each frequency point for the purpose of keeping the signal within the dynamic range of the listener. This is particularly important in the case of a telephone user that suffers from loudness recruitment. The dynamic range is bounded by the threshold value T on the low end, and the pain or discomfort threshold on the high end.

In step 90, the modified frequency domain values undergo an inverse Fourier transformation back to the time domain. In step 100, the four overlap buffers are added to reconstruct the modified speech signal. Each overlap buffer has 64 common sample values, and adding these four overlap buffers will reconstruct the full signal.

In step 110, the signal is converted from digital to analog format in a conventional manner.

In step 120, the analog signal is transmitted to the receiver of a telephone handset.

Figure 2:
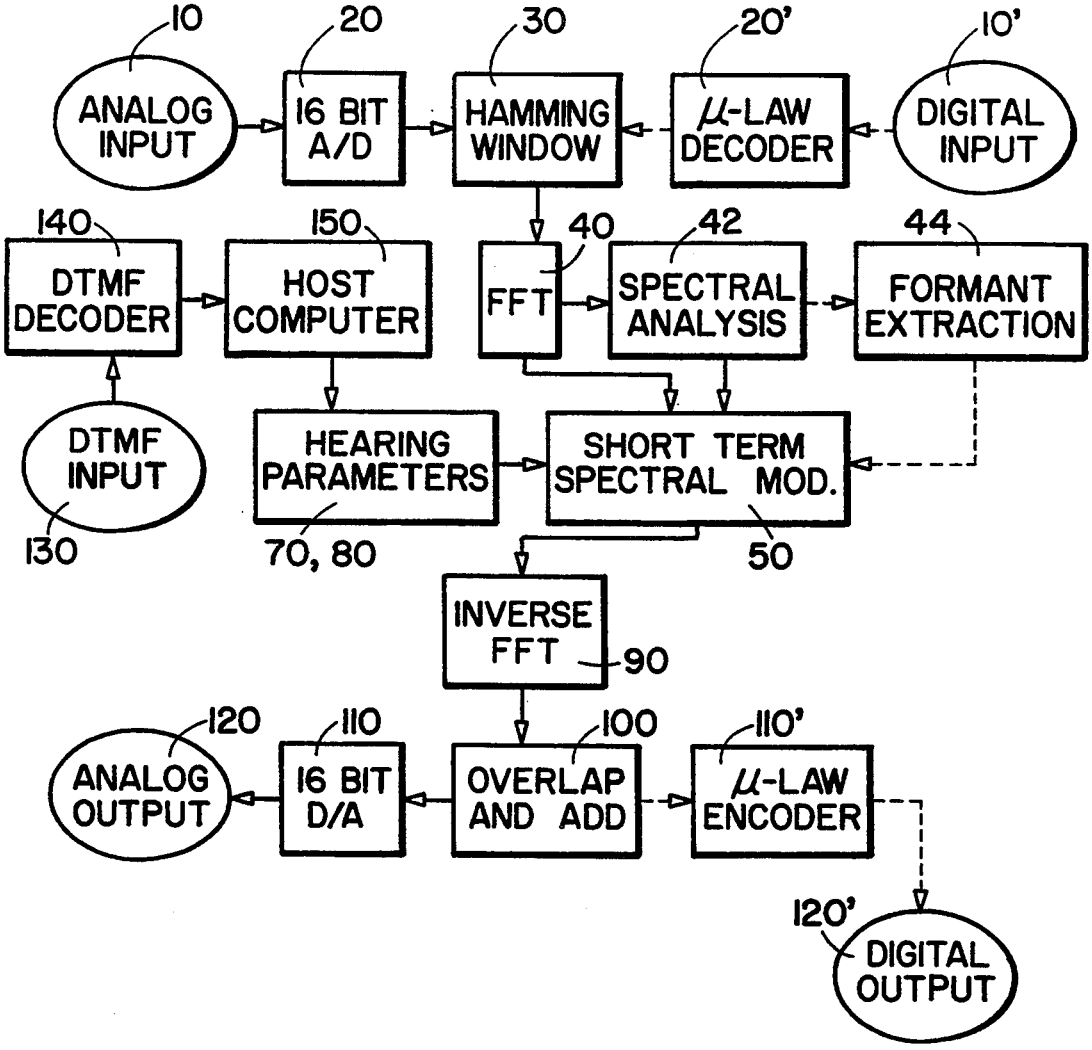
FIG. 2 is an environmental block diagram showing the interface of the system with the hearing impaired user.

FIG. 2 is an alternative representation of the block diagram of FIG. 1, and provides a somewhat more detailed representation of the system of the present invention. In FIGS. 1 and 2, like reference numerals are used to indicate the same steps or operations.

With reference to FIG. 2, the system is also shown to be adaptable to input and output of signals in digital form. The input speech signal may already have been digitized, as indicated at 10'. A $\mu$-law decoder 20' is employed to match the requirements of the digital input signal 10' to the digital form of the system. Similarly, a $\mu$-law encoder 110' converts, as necessary, the form of the spectrally modified speech signal into the suitable form for digital output 120'. In Europe, the $\mu$-law compander would be replaced with an A-law compander.

FIG. 2 also indicates the manner of user interface with the system preparatory to having the system operate on a speech signal. In overview, the system contemplates subscriber access through a Dual Tone Multi-Frequency (DTMF) or Touchtone signalling to turn the processing system on and off and to select among types and degrees of signal processing commands for modification of speech signals in accordance with the subscriber's hearing impairment.

In FIG. 2, the DTMF Input 130 represents a user communication with the system preparatory to a telephone conversation. In this communication, the user can furnish a DTMF coded command through the telephone which activates a predetermined or customized set of hearing parameters for modification of the speech signal in the subsequent call. If predetermined, the user may select from a library of hearing impairment profiles characteristic of common hearing impairment problems. If customized, the user can supply detailed data of his hearing threshold curve and equi-loudness contours so that the appropriate frequency gain in compression can be provided. The user may also during an enrollment procedure provide feedback via touch-tones as to the "comfort level" bands of noise which are presented over the telephone. This information can be used in deciding the appropriate frequency shaping and compression.

Also, it is possible for the user, via the telephonic signal interface, to modify one of the predetermined hearing impairment profiles to produce a closer match to his or her individual hearing impairment problem. Of course, the system will provide for storing a customized set of hearing impairment data once configured for any specific user.

The DTMF decoder 140 is designed to receive the telephonic user input signal and decode it into a format suitable for use by a host computer 150. The computer 150 accesses the T Table 70 and the S Table 80 to select or modify the speech signal according to the requirements of the user.

The parameters for determining the frequency equalization (FE) and frequency equalization with compression (FEC) are based on a knowledge of the user's hearing thresholds and uncomfortable loudness levels (UCL).

The FE processing technique is based directly on the user's hearing thresholds, while the FEC technique is based on a model derived from the user's hearing thresholds and uncomfortable loudness levels. The FE case is set up so that for any given frequency the power in a band is augmented by the user's hearing threshold. This applies to both the time domain and the frequency domain.

The Hearing Impaired (HI) case, from which the FEC case is derived, is calculated by defining two points on power-in, power-out model. These points are the subject's threshold with zero and the subject's UCL and 110 dB A (which is a typical UCL for a normal person). The line that connects these two points will define a threshold and a slope, which will be used when modeling the HI response. If we use $P_{oHI}=m_{HI}P_{iHI}+b_{HI}$ the power-in, power-out relation, where $P_{oHI}$ is power-out and $P_{iHI}$ is power-in for any given frequency, $m_{HI}$ and $b_{HI}$ are determined as follows:

$$m_{HI}=110\text{ dB}/\text{UCL-HT}$$

$$b_{HI}=110\text{ dB HT}/\text{UCL-HT}$$

The FEC case is calculated as the inverse of the Hearing Impaired (HI) model. If the FEC model has the relation $P_{oFEC}=m_{FEC}P_{IFEC}+b_{FEC}$ and we want a unity power gain when a signal is passed through the HI model and then the FEC model, the following must be true:

$$P_{iHI}=P_{oFEC}$$

$$P_{oHI}=P_{iFEC}$$

By making appropriate substitutions, we arrive at the following:

$$P_{iFEC}=m_{HI}(m_{FEC}P_{iFEC}+b_{FEC})+b_{HI}$$

which is equivalent to:

$$P_{iFEC}=m_{HI}m_{FEC}P_{iFEC}+m_{HI}b_{FEC}+b_{HI}$$

This equation can be solved by letting $m_{FEC}m_{HI}=1$ and $m_{HI}b_{FEC}+b_{HI}=0$. Therefore, $$m_{FEC}=1/m_{HI}=UCL-HT/110\ dB$$

$$b_{FEC}=-b_{HI}/m_{HI}=HT$$

The FE case is simpler, since it is not based on the HI model. Instead, the slope ($m_{FE}$) is defined as unity, and the threshold ($b_{FE}$) is the hearing threshold HT. Therefore for any frequency band, the FE model is defined as follows:

$$m_{FE}=1$$

$$b_{FE}=\text{HT}$$

Figure 3:
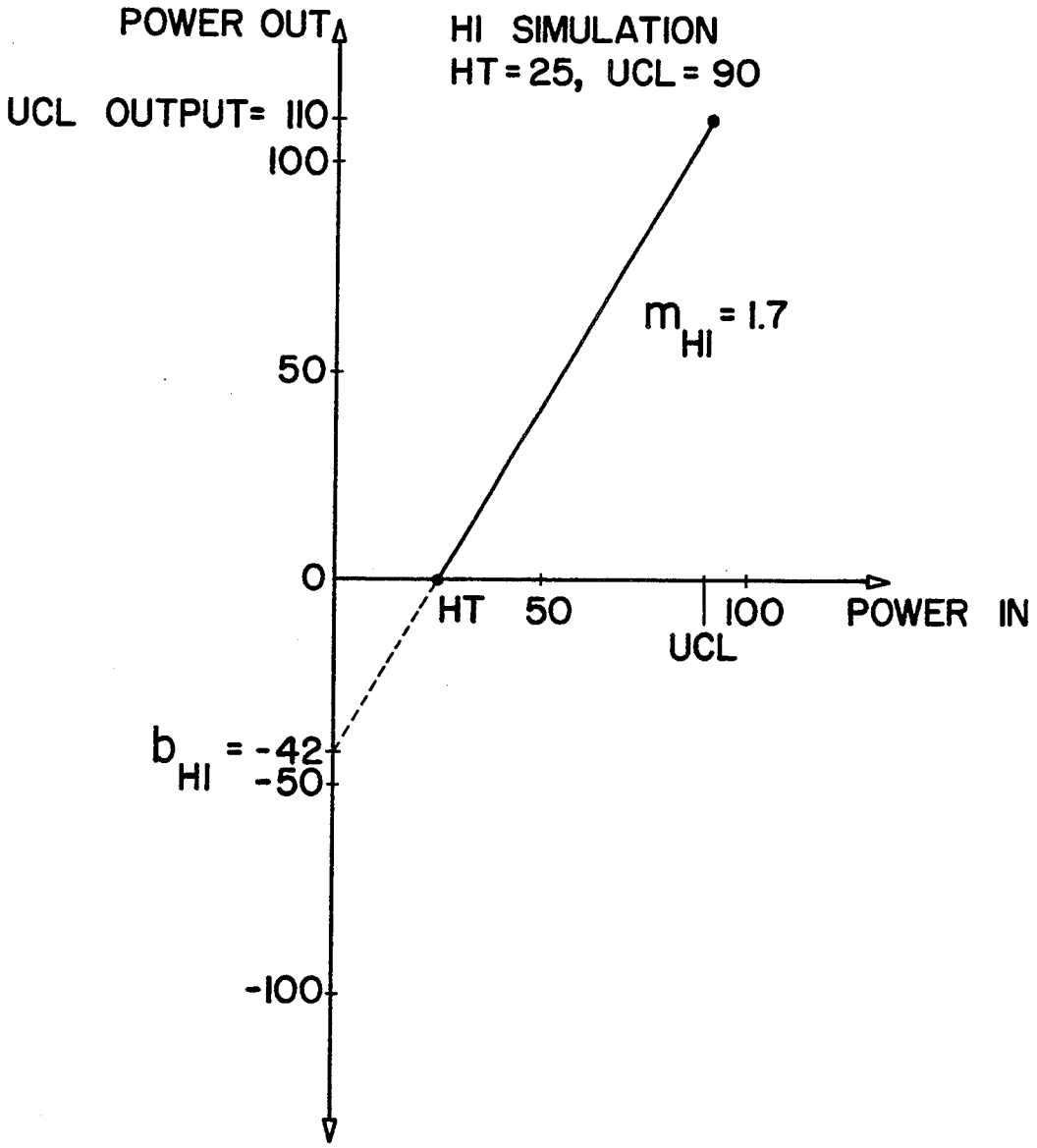
FIG. 3 is a graph showing hearing impaired simulation processing.
Figure 4:
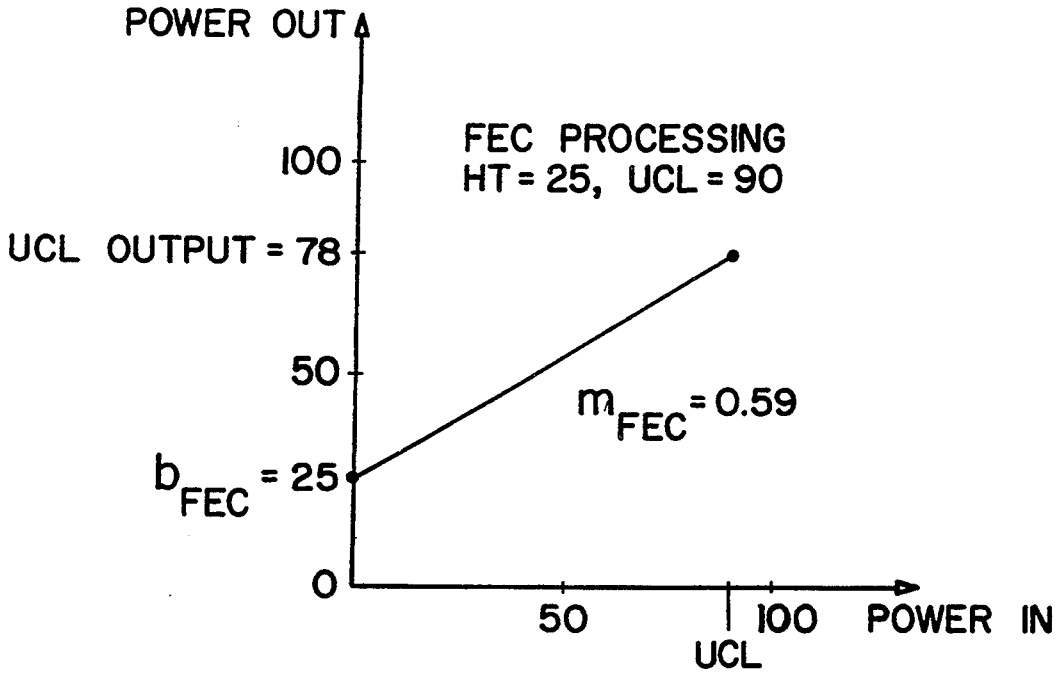
FIG. 4 is a graph showing frequency equalized compression processing.
Figure 5:
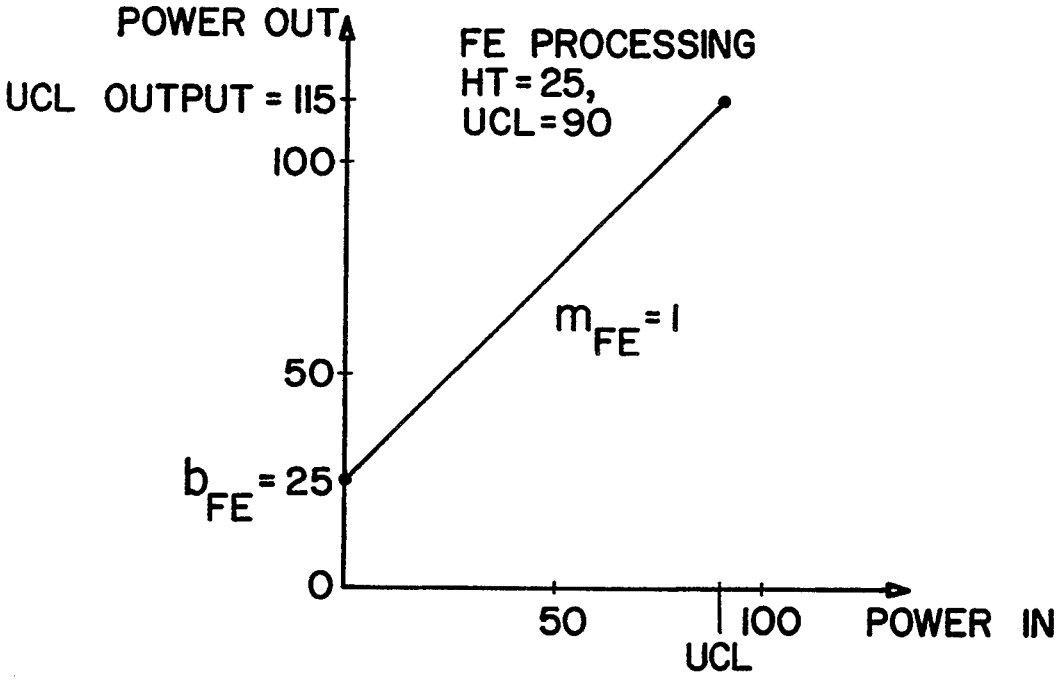
FIG. 5 is a graph showing frequency equalized processing.

FIGS. 3–5 show these models for a fictitious subject with a HT of 25 and a UCL of 90 for one frequency band. FIG. 3 is the power-in, power-out graph for a simulated hearing impairment. FIG. 4 is the power-in, power-out graph for FEC compensation of the same hearing loss, and FIG. 5 is the FE compensation.

The nature of the compression and the number of sub-bands within which compression is applied can be varied. Typically between 2 to 8 compression channels are used. However, using the spectral domain processing method described below, up to 32 individual channels could be processed.

The system can be configured to filter out any specified frequency region. This can be used to remove narrow band noise components. Optionally, another use of this is to remove or suppress the first formant region of the speech signal. This step is indicated as step 44 in FIG. 2. It is known that the first speech formant contributes relatively little to speech intelligibility, and that energy in the first formant region is capable of partially masking the more important second formant. Given the knowledge of the position of the first formant, this system can be used to optionally remove or attenuate the first speech formant. This enables the relative energy in the second formant region to be increased thus increasing the prominence of the second formant.

Against this background, the following explains in greater detail steps 40, 42, 44, 50, 90 and 100 of FIG. 2.

The spectral domain processing technique alters the speech signal through modifications to a frequency domain representation of the signal. For every 64 samples of the signal, 256 samples of the signal are multiplied by a Hamming Window, FFTed in place, modified according to hearing impairment parameters and power levels at the different frequency values, and inverse FFTed.

Four 256 sample buffers are thereby created in a similar manner that have 64 samples in common, that is, the buffers have an overlap of one fourth. The 64 common samples are added together and output as the modified signal.

After the Hamming Window and FFT have been applied to the current overlap buffer, a spectral representation of the signal is achieved that is ready to be modified. For an FFT size of N, N/2+1 unique points of complex frequency information result due to the purely real aspect of the input signal. Point 0 is the DC frequency term and point N/2 is the Nyquist frequency term. Points 1. . . N/2−1 are identical to points N−1. . . N/2+1 because of the even nature of the FFT of real data.

At present, the spectrum is modified as follows. The DC and Nyquist frequencies are zeroed out. The magnitude of each spectral point besides DC and Nyquist is altered such that the output magnitude is a function in the log domain of the input magnitude. At present, the function of output magnitude versus input magnitude is piecewise linear, such that for each spectral point:

$$20\log M_o = 20S\log M_i + T$$

where $M_o = re^2 + im^2$ on output $M_i = re^2 + im^2$ on input

S=slope of line in log domain

T=threshold, or y intercept of line in log domain

The S and T parameters are downloaded from the host computer and depend on the hearing impaired model used. Also, two lines are specified such that if the input magnitude is below a certain level, the S and T of one line is used, but if the input magnitude is above that level, a different S and T are used. The function of output versus input magnitude in the log domain is thus piecewise linear. This allows the type of compression to be set as compression limiting or as compressor compression.

The following is a more detailed derivation of how each spectral point is actually modified by the DSP program:

$$\log M_o = S\log M_i + T/20$$

$$M_o = 10^{S\log Mi + T/20}$$

$$M_o = 10^{T/20}10^{S\log Mi}$$

We want the magnitude of each spectral point to have the new magnitude $M_o$:

$$re \leftarrow re\ M_o/M_i$$
$$im \leftarrow im\ M_o/M_i$$

$$\begin{aligned} M_i &= 10^{\log Mi} \\ M_o/M_i &= M_o M_i^{-1} \\ &= 10^{T/20}10^{S\log Mi}10^{-\log Mi} \\ &= 10^{T/20}10^{(S-1)\log Mi} \end{aligned}$$

Call $M_o/M_i$ a new variable that modifies the amplitude of a spectral point, A:

$$\begin{aligned} A &= M_o/M_i \\ &= 10^{T/20+(S-1)\log Mi} \\ &= 10^{T/20+(S-1)(\log re2+im2)\frac{1}{2}} \\ &= 10^{T/20+(S-1)/2\log(re2+im2)} \end{aligned}$$

The threshold, T, is also further modified by a factor to compensate for effects of the Hamming Window.

Adj=The Hamming Window adjustment

T=(T+Adj(S−1))

Thus, in order to speed up the real-time processing the actual calculation done are:

MT=Power crossover value for determining which T and S to use

P=Power for a given spectral point $T^{1,2/used}$=Threshold values used in real-time computations $S^{1,2/used}$=Slope values used in real-time computations $P = re^2 + im^2$ If P>MT then use $T^2$used and $S^2$used else use $T^1$used and $S^2$used $A = 10^{(Tn/used + Sn/usedP)}$ where n is 1 or 2 accordingly Where the values are defined as:

$T^{n/used} = T + Adj(S-1)/20$ $S^{n/used} = (S-1)/2$

MT=crossover/10

Since these three values remain constant while signal processing is occurring, they are calculated in advance on the host computer.

Figure 6:
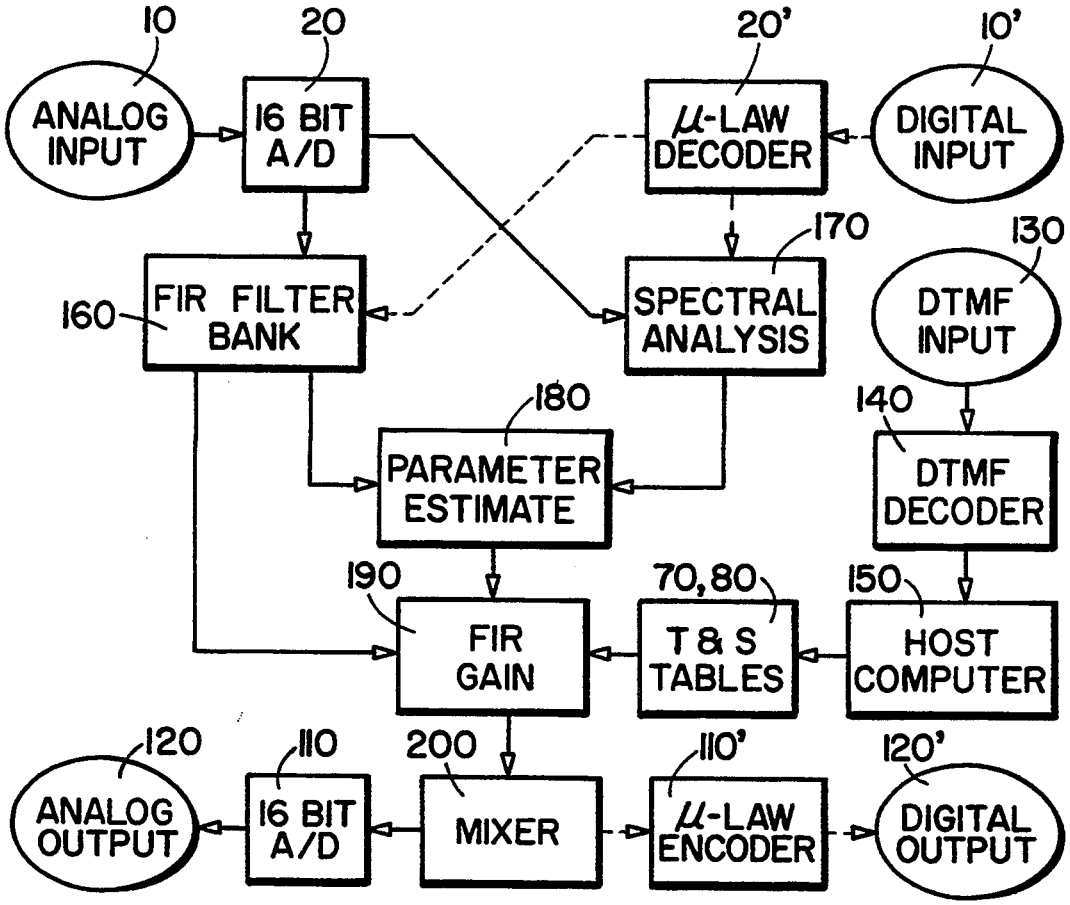
FIG. 6 is another environmental block diagram illustrating an alternative type of adaptive signal processing and the manner of user interface.

An alternative method of processing where the processing is mainly done in the time domain via a digital filter bank is shown in FIG. 6, in which like reference numerals correspond to like steps or operations shown in the spectral domain method of FIG. 2.

In this case, compression of the signal, when it is required, is performed at the output from each filter prior to mixing the signal for presentation to the receiver. In this method, spectral analysis is still performed and used to modify the output gains of filters within the filter bank 160, however, the delay in the signal path is significantly reduced. Using a 16 kHz sampling rate the processing delay is of the order of 2 msec.

The time domain processing technique modifies the incoming signal by passing it through a finite impulse response (FIR) filter bank 160. The individual FIR filter shapes were designed using a window-function technique, where a Hamming window was used. This gives an essentially flat pass-band with the maximum stop-band ripple approximately 53 dB below the passband gain. The exact shape of the FIR filters is not of critical importance. However, their bandwidth and spacing were designed to be on an octave scale, starting at 250 Hz and ending at 4000 Hz. This spacing is used because the frequency selectivity of the human auditory system is on a logarithmic rather than a linear scale. The filter banks consist of 31 tap FIR filters each with a different center frequency. The center frequencies are octave spaced within the telephone bandwidth, and can be set to different values depending on the desired effect. The gain of each filter is calculated from the following equation.

$$A = S^n used\ P + T^n used$$

where $S^n$used is determined as in the above equation and $T^n$used is: $T^n$used=T/20

The power cross over point, MT, is the same as in the spectral processing method. The power value for any given filter, P, is calculated by looking at the previous 32 outputs of the filter, and measuring the power contained in them. These filter outputs are then summed and passed out the DSP board.

The computations for the time-domain processing are identical to the previous, with the following exceptions. There is no Hamming Window adjustment, since a Hamming Window is not used in the time-domain, and the power is determined by looking at the last 32 output points of a given filter in the filter bank.

The time domain processing method also provides for spectral analysis of the digitized speech signal at 170. In step 180, an estimate is made of the hearing impairment parameters based on the output of the FIR filter bank 160 and the spectral analysis 170. The filtered, digitized speech signal is then multiplied by the S and T parameters appropriate for one hearing impaired user in step 190. After the FIR gain operation, the output signal is mixed by summing the filter outputs in step 200 to reproduce the speech signal. In the usual manner the output may be in analog form 120, or digital form 120.

The invention has been described in an illustrative embodiment, and it is to be understood that other embodiments may suggest themselves to persons of ordinary skill in the art without departing from the scope of the appended claims.

What is claimed is:

1. For use in an improved telephone network having predetermined hearing impairment profiles and a database for storing customized hearing impairment profiles to compensate a speech signal for a hearing impairment of a telephone user, a method for adaptively processing a speech signal comprising:

a) transforming a digital representation of the speech signal into a spectral domain representation having a plurality of frequency point values;

b) modifying the frequency point values in accordance with the predetermined hearing impairment profile or the customized hearing impairment profile defining a frequency range to be modified corresponding to the hearing impairment of the telephone user,;

c) performing an inverse transformation of the modified frequency point values into an adapted digital signal; and d) transmitting the adapted signal to the telephone user.

2. The method of claim 1 wherein the speech signal originates in analog form and the signal is preliminarily converted to a digital format.

3. The method of claim 1 including the preliminary step of using multiple overlap buffers to store the digital speech signal prior to transforming the signal into the spectral domain.

4. The method of claim 3 wherein the buffering step includes center-weighting a range of samples of the digital speech signal.

5. The method of claim 1 wherein the signal transformation of step a) is performed by a fast Fourier transform algorithm.

6. The method of claim 1 wherein the signal modulation of step b) includes amplifying each frequency point valve by a predetermined amount, as necessary, to exceed the low sensory threshold for the hearing impairment at that frequency.

7. The method of claim 1 wherein the signal modulation of step b) includes compressing each frequency point value by a predetermined amount, as necessary, to a value below the abnormal loudness perception level for the hearing impairment at that frequency.

8. The method of claim 1 wherein the step of performing an inverse transformation is performed by an inverse fast Fourier transformation algorithm.

9. The method of claim 8 wherein the first formant of the signal is extracted.

10. For use in an improved telephone network having predetermined hearing impairment profiles and a database for storing customized hearing impairment profiles to compensate a speech signal for a hearing impairment of a telephone user, a method for adaptively processing an analog speech signal having a plurality of format regions comprising:

converting the signal to a digital format and storing the digital format using multiple overlap buffers including center-weighting a range of samples of the digital signal;

transforming a digital representation of the speech signal into a spectral domain representation having a plurality of frequency point values utilizing a fast Fourier transform algorithm;

modifying the frequency point values in accordance with the predetermined hearing impairment profile or the customized hearing impairment profile defining a frequency range to be filtered corresponding to the hearing impairment of the telephone user, the frequency point value modification including amplifying and compressing each frequency point value as necessary to exceed a low sensory threshold and to compress to a value below the abnormal loudness perception level, respectively, for the hearing impairment at that frequency, and the modifying including selectively extracting, attenuating and amplifying the plurality of format regions;

performing an inverse transformation of the modified frequency point values into an adapted digital signal; and transmitting the adapted signal to the telephone user.

11. The method of claim 10 wherein a first format region of the signal is extracted.

12. For use in an improved telephone network having predetermined hearing impairment profiles and a database for storing customized hearing impairment profiles to compensate the signal for a hearing impairment of a telephone subscriber, a system for adaptively processing a speech signal comprising:

a host computer adapted to receive a subscriber command for modification of a telephone speech signal in accordance with the subscriber's hearing impairment;

access means for communicating a subscriber command to the host computer;

adaptive processor operatively coupled to the host computer for modifying the telephone speech signal in accordance with the subscriber command; and transmitter for transmitting the modified telephone speech signal through the telephone network to the subscriber.

13. The improved telephone network of claim 12 wherein the host computer includes a database for storing a predetermined set of subscriber commands, and the access means provides for subscriber selection of a predetermine command.

14. The improved telephone network of claim 13 wherein the access means further includes the function of providing subscriber customization of said predetermined command.

15. The improved telephone network of claim 14 wherein the database includes the further function of storing the customized predetermined command for future access by the subscriber.

16. The improved telephone network of claim 12 wherein the access means includes a decoder adapted to receive a tone-based signal from the subscriber and decode it into an equivalent signal recognizable by the host computer.

17. The improved telephone network of claim 12 wherein the access means includes the function of allowing the subscriber to turn the adaptive processing means on and off.

18. The improved telephone network of claim 12 wherein the adaptive processor includes means for modifying the speech signal through a spectral domain representation of the signal.

19. The improved telephone network of claim 12 wherein the adaptive processor includes means for modifying the speech signal through a time domain representation of the signal.

* * * * *

UNITED STATES PATENT AND TRADEMARK OFFICE

CERTIFICATE OF CORRECTION

PATENT NO. : 5,388,185

DATED : February 7, 1995

INVENTOR(S) : Alvin M. Terry, et al

It is certified that error appears in the above-identified patent and that said Letters Patent is hereby corrected as shown below:

| | | |
|---|---|---|
| Column 2, | Line 3, | After "commonly" insert --be--. |
| Column 2, | Line 26, | Replace "telephone-conversation" with --telephone conversation--. |
| Column 3, | Line 14, | After "invention" delete ";". |
| Column 3, | Line 47, | "DSP-32C-chip" should read --DSP-32C chip--. |
| Column 5, | Line 53, | After "$b_{HI}$" and before "the" insert --as--. |
| Column 5, | Line 59, | "$b_{HI}$=110" should read as follows: --$b_{HI}$= - 110--. |
| Column 8, | Line 6, | "calculation" should be --calculations--. |

UNITED STATES PATENT AND TRADEMARK OFFICE

CERTIFICATE OF CORRECTION

PATENT NO. : 5,388,185 Page 2 of 2

DATED : February 7, 1995

INVENTOR(S) : Alvin M. Terry, et al

It is certified that error appears in the above-identified patent and that said Letters Patent is hereby corrected as shown below:

| | | |
|---|---|---|
| Column 8, | Line 17, | "$A=10^{(Tn/used+Sn/usedP)}$" should read: --$A=10^{(Tn/used+Sn/usedP)}$--. |
| Column 8, | Line 43, | After "Hamming" replace "window" with --Window--. |
| Column 9, | Line 18, | After "digital form" replace "120" with --120'--. |
| Column 9, | Line 39, | After "user" delete ",". |
| Column 9, | Line 61, | After "point" replace "valve" with --value--. |
| Column 10, | Lines 4-5, | should read -- 9. The method of claim 1, further including a step after said d) of reconstructing the adaptively processed speech signal by adding overlapping buffers.-- |

Signed and Sealed this

Third Day of February, 1998

*Attest:*

Bruce Lehman

BRUCE LEHMAN

*Attesting Officer*

*Commissioner of Patents and Trademarks*